US008560111B2

(12) United States Patent
Zhang et al.

(10) Patent No.: US 8,560,111 B2
(45) Date of Patent: Oct. 15, 2013

(54) METHOD OF DETERMINING PRESSURE TO APPLY TO WAFERS DURING A CMP

(75) Inventors: John H. Zhang, Fishkill, NY (US); Walter Kleemeier, Hopewell Junction, NY (US); Ronald K. Sampson, Hopewell Junction, NY (US)

(73) Assignee: STMicroelectronics, Inc., Coppell, TX (US)

( * ) Notice: Subject to any disclaimer, the term of this patent is extended or adjusted under 35 U.S.C. 154(b) by 908 days.

(21) Appl. No.: 12/649,037

(22) Filed: Dec. 29, 2009

(65) Prior Publication Data

US 2010/0167629 A1 Jul. 1, 2010

Related U.S. Application Data

(60) Provisional application No. 61/142,155, filed on Dec. 31, 2008.

(51) Int. Cl.
*G06F 19/00* (2011.01)

(52) U.S. Cl.
USPC ..... 700/164; 700/175; 451/5; 451/57

(58) Field of Classification Search
USPC ..... 700/121, 164, 175; 451/5, 57
See application file for complete search history.

(56) References Cited

U.S. PATENT DOCUMENTS 7,029,382 B2 4/2006 Maloney et al.
2004/0023606 A1 * 2/2004 Wang et al. ..... 451/296

* cited by examiner

*Primary Examiner* — Sean Shechtman
(74) *Attorney, Agent, or Firm* — Seed IP Law Group PLLC

(57) ABSTRACT

A method for uniformly planarizing a wafer that includes determining a first wafer warped value at a first zone on the wafer, determining a second wafer warped value at a second zone on the wafer, and calculating a pressure difference based on the first and second wafer warped values at the first and second zones is provided. The method also includes performing a chemical mechanical polishing of the wafer, applying a first pressure based on the first wafer warped value to the wafer at the first zone during the chemical mechanical polishing, and applying a second pressure based on the second wafer warped value to the wafer at the second zone during the chemical mechanical polishing, a difference between the first pressure and the second pressure based on the pressure difference.

16 Claims, 2 Drawing Sheets

METHOD OF DETERMINING PRESSURE TO APPLY TO WAFERS DURING A CMP

BACKGROUND

1. Technical Field

The present disclosure is directed to a method of determining a plurality of pressures to apply to a wafer during a chemical mechanical polish based on a curvature induced by a film formed on the wafer.

2. Description of the Related Art

The CMP process applies chemical and mechanical forces to the surface of the wafer to prepare a smooth surface for further processing. Pressure is applied to a back of the wafer in a CMP machine to bring the surface of the wafer into contact with a pad and slurry, which are selected to remove a specific film formed on the wafer. In conventional CMP processes, pad and slurry selection, process parameter optimization, and endpoint selection and recipe optimization are widely used methods for improving the post CMP film uniformity and defect. All of these methods have a common point of view, which is based on the type of material being etched. For example, the manufacturer must choose different pad, slurry, and endpoint detectors for metal film and dielectric film to optimize the process. As the technology shrinks to 32 nm and beyond, the standards for the requirements for post CMP uniformity and defect go high. The conventional CMP processes face big challenges to meet these high standards.

BRIEF SUMMARY

According to principles of the present invention, the curvature of the wafer based on the tensile or compressive stress of the layer being polished is considered to determine a variation in pressure to apply to a back of the wafer during a CMP. Wafer warpage at a plurality of locations on the wafer prior to performing the CMP is determined. The CMP is carried out using a range of different pressures at different locations on the wafer.

As wafers become larger and the technology shrinks down to the 32 nm node and beyond, manufacturers face challenges to achieve reliable post-CMP uniformity of films applied to the wafer. Depositing a film on the wafer causes the wafer to develop a curvature that depends on the film's characteristics. In order to remove uneven topography on a surface of the wafer while achieving a uniform thickness of the remaining film, the CMP process should factor in the curvature of the wafer.

In semiconductor processing, films or layers deposited on a wafer are either tensile or compressive. The tensile or compressive stress causes the wafer to curve so a surface of the wafer is not uniform. During a chemical mechanical polishing (CMP) to planarize the peaks and valleys caused by underlying device features, the curvature of the wafer adversely impacts the uniformity of the polish.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings.

DETAILED DESCRIPTION

Figure 1:
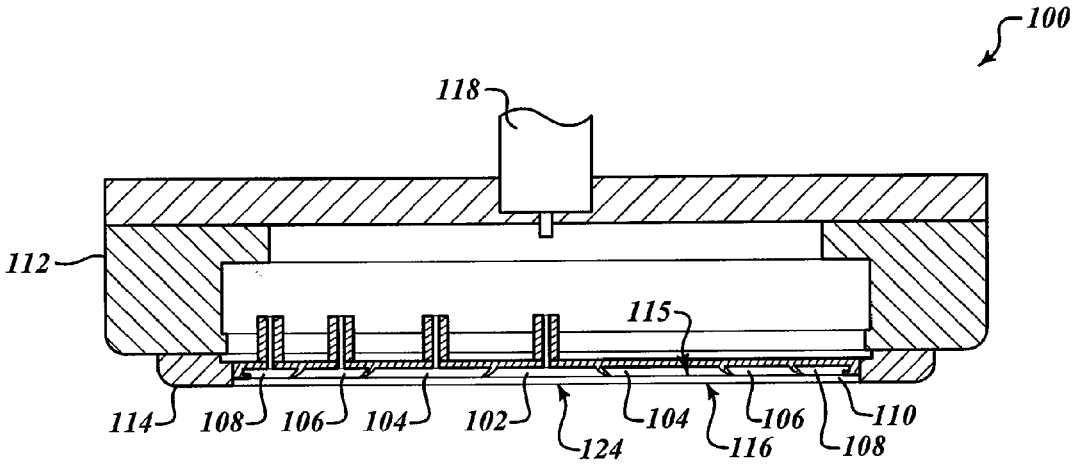
FIG.1 (Prior Art)
FIG. 1 is a cross-sectional view of a portion of a known prior art chemical mechanical polishing machine having a plurality of pressure zones that is used in a new manner in this invention.

In the following description, certain specific details are set forth in order to provide a thorough understanding of various embodiments of the disclosure. However, one skilled in the art will understand that the disclosure may be practiced without these specific details. In some instances, well-known structures associated with the manufacturing of semiconductor wafers have not been described in detail to avoid obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the drawings, identical reference numbers identify similar features or elements. The size and relative positions of features in the drawings are not necessarily drawn to scale.

Compressive and tensile stresses caused by layers formed on the wafer become more pronounced as the diameter of wafers increase. Since many of the layers are deposited at elevated temperatures, different thermal expansion coefficients between the layer and the wafer create mechanical stress as the wafer cools. Stress may also be induced by the microscopic structure of the deposited layer. These stresses cause the wafer to curve, which can induce cracks, voids, delamination, and other defects that impact yields and reliability.

FIG. 1 shows a portion of a known CMP machine head 100 having four pressure zones 102, 104, 106, and 108 positioned to apply different pressures to a back surface 115 of the wafer 110. The pressure zones 102-108 are pressurized concentric tubes that are configured to contact the back surface 115 of the wafer 110. A carrier 112 holds the wafer 110 in place during transport and during the CMP process. A retaining ring 114 coupled to the carrier 112 ensures the wafer 110 remains in position with respect to the pressure zones 102-108 during the CMP process. It is known in the prior art to use a wafer carrier having a plurality of different pressure zones as disclosed in U.S. Pat. No. 7,029,382 ("the '382 patent"), incorporated herein by reference. FIG. 1 of this application is a copy of FIG. 13 from the '382 patent, but the '382 patent does not teach to take into account stress induced in a wafer by the layers deposited thereon to vary the pressure at different locations on the wafer.

A method of the invention achieves a uniform CMP on a wafer 110 by accounting for the stress induced by the film at each of a plurality of zones of the wafer 110. The method detects a level of interaction between the deposited film and the wafer 110 prior to performing the CMP. The level of interaction relates to a wafer curvature or warpage due to the stress caused by the film. Pre-CMP measurements or stress values are determined at each zone of the wafer that relate to the curvature of the wafer at each zone. These values are transformed into a technique to vary an amount of down pressure applied to the wafer by a plurality of pressure zones in the CMP machine 100.

Pressure is pneumatically applied to the back of the wafer 110 during the CMP process at each pressure zone 102-108 to remove topography from the layers that form during semiconductor processing. For example, a silicon dioxide layer may be deposited to fill in trenches formed on the front surface 116 of the wafer 110 or to isolate devices. The silicon dioxide will be deposited to a thickness that is greater than a final thickness of the silicon dioxide layer. The excess silicon dioxide is removed and planarized by the CMP process to prepare the front surface 116 of the wafer 110 for further processing. Several materials can be planarized by the CMP process including silicon nitride, poly silicon, and metals, such as aluminum, copper, and tungsten.

The CMP process uses a combination of chemical etching and mechanical force to smooth the front surface of the wafer. The chemical slurry etches the front surface while an abrasive pad grinds the front surface of the wafer. A different pad and slurry are used for each type layer formed on the wafer. The different CMP processes are configured to selectively remove a specific layer while not damaging the underlying layers.

The wafer 110 has an active face 116, sometimes called the front surface, in which transistors and other integrated circuits are formed. The front surface 116 of the wafer 110 is positioned facing the pad positioned on a platen that rotates. The pad and platen are not shown in FIG. 1, since they are well known in the art. The wafer 110 is held by the carrier 112 and the retaining ring 114, which may be configured to rotate and oscillate during the CMP process. The back side of the wafer 115 has pressure applied by the carrier 112 to force it into the pad during CMP.

In some embodiments, additional compressive pressure is applied by the carrier 112 from a vertical support 118. Vacuum pressure may be applied through the vertical support 118 to hold the wafer 110 in place during transport. In addition, the back pressure applied through the pressure zones 102-108 may be provided through the vertical support 118.

Figure 2:
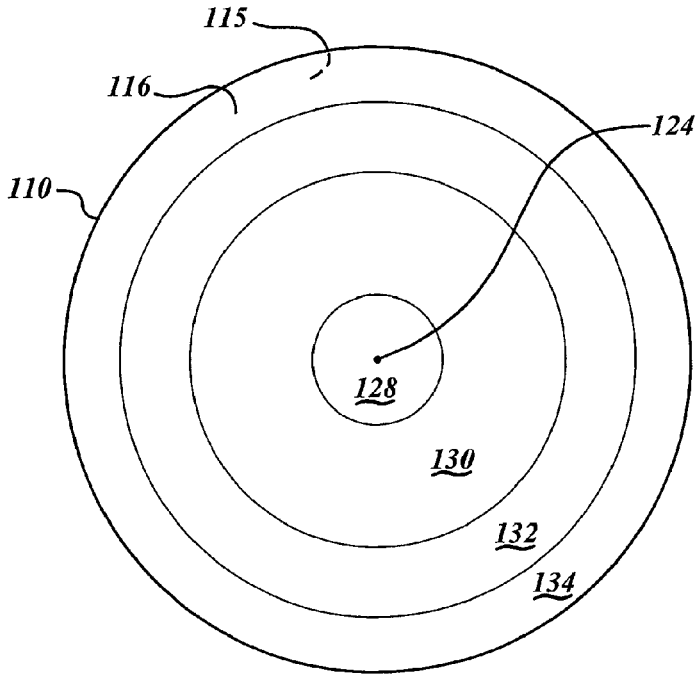
FIG. 2 is a top plan view of a plurality of zones on a wafer.

FIG. 2 is a top plan view of the wafer 110 having a front surface 116 that has a plurality of layers or thin films deposited or grown on the wafer 110. The wafer 110 can be considered to have pressure applied into four zones 128, 130, 132, and 134 that correspond to the pressure zones 102, 104, 106, and 108, respectively, of the CMP machine 100. The zones 128, 130, 132, and 134 on the wafer 110 are concentric rings that each has a width that relates to the respective four pressure zones 102, 104, 106, and 108. If the CMP head 100 has three zones, then the wafer 110 can be considered on the basis that three zones of pressure will be applied, and so forth.

Positioned at a center 124 of the wafer 110, a first circular zone 128 has a diameter that corresponds to a diameter of the first pressure zone 102. A second zone 130 abuts the circular zone 128 at the center 124 of the wafer 110 and is a concentric ring having the same width as the second pressure zone 104. A third zone 132 abuts the second zone 130 and has a width that is smaller than the second zone. The third zone 132 corresponds to the third pressure zone 106. A fourth zone 134 of the wafer 110 corresponds to the fourth pressure zone 108. The number of zones associated with the wafer 110 depends on the number of pressure zones present in the CMP machine 100, which can be varied as needed.

A variety of thin films are deposited to form the layers that form the front surface 116 of the wafer 110. Each film impacts the curvature of the wafer 110 in a specific way that depends on the deposition characteristics and atomic structure of the film. If the atomic structure of the film is different from the wafer 110, stress present in the layer may cause a curvature in the wafer.

Figure 3:
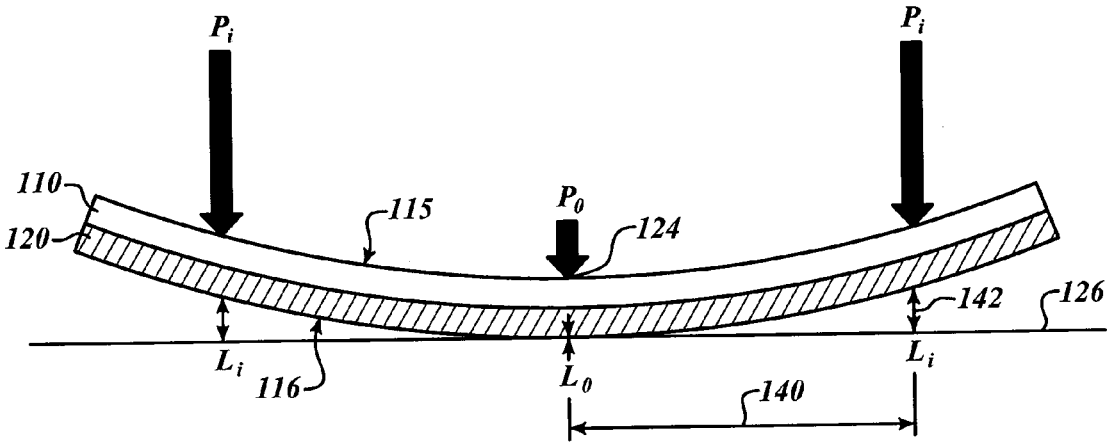
FIG. 3 is a cross-sectional view of a compressive film formed on a wafer.
Figure 4:
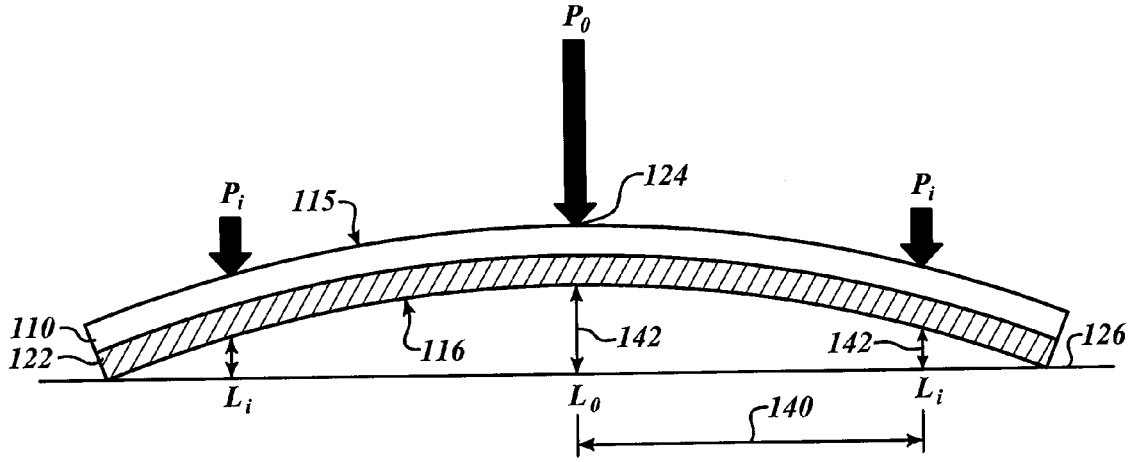
FIG. 4 is a cross-sectional view of a tensile film formed on a wafer.

FIGS. 3 and 4 are cross-sectional views of the wafer 110 having a curvature induced by compressive and tensile films, respectively. The values $L_0$, $L_i$ relate a distance 140 from the center 124 of the wafer 110 and a variation 142 from a reference plane 126 to the surface 116 of the wafer 110. The values $L_0$ and $L_i$ can be used to calculate the different curvatures of the wafer 110 at the distances 140.

In accordance with the method, a curvature or stress value, $L_i$, is determined at a selected location within each zone 128, 130, 132, and 134 across the wafer 110. For the CMP machine 100, four values will be acquired, $L_0$, $L_i$, one corresponding to each pressure zone 102-108. The first value, $L_0$, is determined at the center 124 of the wafer 110 and is a reference point for the other values. Accordingly, the second, third, and fourth values $L_1$–$L_3$ are determined in the second, third, and fourth zones 130, 132, and 134 on the wafer 110, respectively.

FIG. 3 is a cross-sectional view of a compressive film or films 120 formed on the wafer 110 causing the wafer to curve upward at the edges and forward towards the center 124. The front surface 116 of the wafer 110 is shaped like a convex lens. The compressive film 120 expands to be larger than the wafer 110, resulting in the curvature. Some nitride films and some dielectric films are compressive.

FIG. 4 is cross-sectional view of a tensile film or films 122 formed on the wafer 110 causing the wafer to curve away from the center 124. The edges bend downward and the center 124 lifts upward. The front surface 116 of the wafer 110 forms a concave lens shape. After deposition, the tensile film 122 contracts to be smaller than the wafer 110, and results in the curvature. Most metal films and some dielectric films create tensile stress on the wafer 110.

After deposition of the film 120, 122, the wafer 110 is transported to a measuring apparatus, which may be within the CMP machine 100 or may be a separate apparatus configured to communicate with the CMP machine 100. The pre-CMP values $L_0$, $L_i$ acquired are based on direct measurement of wafer warpage at each location on the wafer $L_i$ and subsequently determine the variations in pressure to apply with the pressure zones 102-108 to uniformly polish the wafer.

For the compressive film in FIG. 3, the reference point, $L_0$ is zero because the center 124 of the wafer 110 is adjacent a reference plane 126. The variations 142 for $L_1$, $L_2$ and $L_3$, become increasingly larger as the distance 140 increases and the wafer curves away from the reference plane 126. This distance from the reference plane 126 may be measured in microns. For example, $L_i$ in FIG. 2, may be 0.6 microns from the reference plane 126 to the front surface 116 of the wafer.

Various sensors may be included in the CMP machine 100 to perform the measurements of the wafer 110. For example, a Makyoh sensor system may be used to measure the geometry of the wafer. Alternatively, the deposition process and type of material deposited and its thickness may be used to calculate by math an estimate of the values $L_i$ and $L_0$ instead of physical measurements. Other known methods of measurement may be used and will not be described in detail.

Since the zones 128, 130, 132, and 134 of the wafer 110 have various widths that relate to the pressure zones 102, 104, 106, and 108, the manufacturer determines the distance 140 from the center 124 in each zone that is the precise location for detecting the variation 142. The distance from the center may be associated with the variable i, i.e., 0-3 in this case. Therefore, each valued $L_1$ $L_2$ and $L_3$ acquired from a plurality of wafers 110 will correspond to the precise location preselected by the manufacturer.

Once the stress values $L_0$, $L_i$ are determined, the Formula 1 is used to determine the pressure difference $P_0$-$P_i$ to apply between two zones on the wafer 110.

$$P_0-P_i=k*c_i*(L_0-L_i) \quad (1)$$

The value $P_i$, corresponds to the down force or pressure applied to the back of the wafer 110 in the CMP machine head 100 at each of the zones 128, 130, 132, and 134. More particularly, $P_i$ is the down force applied to the zone associated with $L_i$. The actual pressure to apply will be different for each CMP polish, the material being etched, etch speed, and other factors. Formula 1 does not determine the exact pressure to apply to the back of the wafer rather the formula determines a difference between the pressure for the first zone 128 at the center 124 of the wafer, $P_0$, and the pressure at another zone 130, 132, or 134 of the wafer, $P_i$.

The pressure at the center 124 of the wafer 110, $P_0$, is a reference pressure from which the compensation of the other pressures is either positive or negative with respect to the reference pressure. The pressure applied at each zone either increases or decreases from the reference pressure in accordance with the values $L_0$, $L_i$.

FIG. 3 shows three arrows related to different amounts of pressure $P_0$ and $P_i$ applied to zones of the back surface 115 of the wafer 110 by the CMP machine 100. Two arrows positioned toward the edges of the wafer 110 are associated with a larger pressure, $P_i$. Since the surface 116 of the wafer 110 curves away from the reference plane 126, the larger pressure $P_i$ pushes the curved edges down toward the pad to more uniformly CMP the wafer 110 during the CMP process. Accordingly, the smaller arrow at the center 124 of the wafer 110 corresponds to a smaller amount of pressure that will be applied during the CMP.

FIG. 4 also shows three arrows that indicate different amounts of pressure to be applied by the CMP machine to the back surface 115 of the wafer 110, which is curved due to the tensile layer 122. Since the variation 142 at $L_0$ is larger than the other variations, a greater pressure $P_0$ is applied to the center 124 of the wafer 110 with the first pressure zone 124. Moving away from the center 124, each consecutive zone receives a smaller pressure $P_i$. The CMP machine 100 may apply the different pressures $P_0$ and $P_i$ concurrently, simultaneously, or continuously to achieve a uniform CMP.

The value k is the dielectric constant of the film formed on the wafer 110. Every material has a dielectric constant that is the ratio of the permittivity of a material to the permittivity of free space. Materials with low dielectric constants are used for dielectrics in semiconductor processing, such as silicon dioxide that has a dielectric constant of 3.9.

The value, $c_i$, is the absolute value of the curvature of the wafer 110 at the precise location of the variation, $L_i$. The formula for curvature for a plane curve give by y=f(x) is:

$$\kappa = \frac{|y''|}{(1+y'^2)^{3/2}}. \quad (2)$$

The y" value corresponds to the variation 142 from the wafer surface 116 to the reference plane 126. The y' value corresponds to the distance 140 from the center 124 of the wafer to the location where the variation 142 was determined. Using Formula 2, the curvature of the wafer at the $L_i$ location is determined from the distance 140 and the variation 142. After determining the curvature associated with $L_i$ the variation in pressure is determined with Formula 1. The value of $L_0-L_i$ is the difference in the variation 142 at the reference $L_0$ and the variation 142 at the distance 140, $L_i$.

The curvature value is determined for a precise distance 142 for each zone 128, 130, 132, and 134 of the wafer. Subsequently, the pressure variations are determined with each curvature value in accordance with Formula 1.

The method may be repeated during the CMP process to more precisely planarize the wafer. As portions of a layer are removed, the curvature of the wafer is affected. If the measurement apparatus is included in the CMP machine, the pressure profile may be adjusted as the curvature of the wafer changes. The measurements are real time feed forward information that enhances post-CMP uniformity.

In another embodiment, several wafers from a batch of wafers may be measured to determine an average wafer warpage value at a specific stage of the processing for the wafers. The average variation 142 for a precise distance 140 may be calculated from several wafers. An average curvature value may be calculated and processed to determine the pressure differences to uniformly CMP the wafers. The CMP machine 100 is programmed to apply the specific pressure differences to each wafer in that batch. This can save the manufacturer time by avoiding determining the values $L_0$ and $L_i$ and pressure variations for each individual wafer.

The method provides an in situ CMP film profile controller that can be used to more uniformly CMP a wafer or plurality of wafers. The method can improve the accuracy of endpoint detection techniques used by the manufacturer by enabling a more consistent polish. By adjusting the down force applied to each zone of the wafer to accommodate the specific curvatures, the local stress caused by the CMP process is reduced at each of the various zones. The reduction in local stress reduces the post-CMP defects, like cracks and voids.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method for uniformly planarizing a wafer, comprising:

determining a first radius of curvature of a substrate at a first zone on the wafer, the wafer including the substrate and a first layer on the substrate, the first layer causing the entire substrate to have either convex shape or a concave shape;

determining a second radius of curvature of the substrate at a second zone on the wafer;

calculating a pressure difference using the first radius of curvature and the second radius of curvature, the pressure difference being a difference between a first pressure to be applied to the first zone and a second pressure to be applied to the second zone;

performing a chemical mechanical polishing of the wafer;

applying the first pressure to the wafer at the first zone during the chemical mechanical polishing; and applying the second pressure to the wafer at the second zone during the chemical mechanical polishing.

2. The method of claim 1 wherein the first pressure and the second pressure are applied to the wafer concurrently.

3. The method of claim 1 wherein the first zone relates to a center of the wafer and the second zone relates to one of a plurality of zones spaced from the center of the wafer.

4. The method of claim 1, further comprising forming the first layer as a tensile film on the substrate prior to determining the first radius of curvature.

5. The method of claim 1, further comprising forming the first layer as a compressive film on the substrate prior to determining the first radius of curvature.

6. The method of claim 1 wherein calculating the pressure difference comprises:

calculating the pressure difference by multiplying a film constant by a difference between the first radius of curvature and the second radius of curvature.

7. The method of claim 6, wherein calculating the pressure difference includes applying the following formula:

$$P_0-P_i=k_1*c_i*(L_0-L_i)$$

wherein $L_0$ is the first radius of curvature at the first zone on the wafer;

$L_i$ is the second radius of curvature at the second zone on the wafer;

$P_0$ is the first pressure applied at the first zone;

$P_i$ is the second pressure applied at the second zone;

$k_1$ is the film constant; and $c_i$ is an absolute value of the second radius of curvature at the second zone.

8. A system configured to uniformly planarize a wafer, comprising:

a wafer planarization machine having a plurality of pressure regions that correspond to a plurality of zones of the wafer, the wafer including a substrate and a first layer on the substrate, the first layer causing the entire substrate to have either convex shape or a concave shape, the wafer planarization machine including:

a detection device configured to determine a first radius of curvature of the substrate at a first zone of the wafer and a second radius of curvature of the substrate at a second zone of the wafer;

a processor coupled to the detection device and configured to determine a pressure difference from the first radius of curvature and the second radius of curvature, the pressure difference being a difference between a first pressure to be applied to the first zone and a second pressure to be applied to the second zone; and a controller coupled to the processor and configured to apply the first pressure with a first pressure region to the first zone of the wafer and the second pressure with a second pressure region to the second zone of the wafer during a chemical mechanical planarization.

9. The system of claim 8 wherein the first zone is at a center of the wafer and the second zone is at one of the plurality of zones spaced from the center of the wafer.

10. The system of claim 8 wherein the first radius of curvature is a reference radius of curvature and the second radius of curvature is a deviation from the reference radius of curvature.

11. The system of claim 8 wherein the first layer is a tensile film formed on the substrate before the detection device determines the first radius of curvature.

12. The system of claim 8 wherein the first layer is a compressive film formed on the substrate before the detection device determines the first radius of curvature.

13. The system of claim 8 wherein the processor is configured to calculate the pressure difference by multiplying a film constant by a difference between the first radius of curvature and the second radius of curvature.

14. The system of claim 13 wherein the processor is configured to calculate the pressure difference with the following formula:

$$P_0-P_i=k_1*c_i*(L_0-L_i)$$

wherein $L_0$ is the first radius of curvature at the first zone on the wafer;

$L_i$ is the second radius of curvature on the second zone on the wafer;

$P_0$ is the first pressure applied at the first zone;

$P_i$ is the second pressure applied at the second zone;

$k_1$ is the film constant; and $c_i$ is an absolute value of the second radius of curvature at the second zone.

15. A method, comprising:

determining a first radius of curvature of a substrate at a zone away from a center of a wafer, the wafer including a first layer formed on the substrate, the first layer configured to make the substrate a convex shape or a concave shape, $L_i$ representing the first radius of curvature;

determining a second radius of curvature of the substrate at the center of the wafer, $L_0$ representing the second radius of curvature;

applying pressure to the wafer during a chemical-mechanical planarization using the first radius of curvature and the second radius of curvature in accordance with the following formula:

$$P_0-P_i=k_1*c_i*(L_0-L_i)$$

wherein $P_i$ represents the pressure applied at the zone away from the center of the wafer;

$P_0$ represents the pressure applied at the center of the wafer;

$k_1$ represents a film dependent constant; and $c_i$ represents an absolute value of the first radius of curvature where the radius of curvature is $L_i$.

16. The method of claim 15, further comprising forming a layer on the wafer prior to determining the first radius of curvature.

* * * * *